United States Patent [19]

Melnik et al.

[11] Patent Number: 4,893,599

[45] Date of Patent: Jan. 16, 1990

[54] MANUAL BYPASS FOR AN ELECTRONIC FUEL INJECTOR

[75] Inventors: George Melnik, New Castle County, Del.; Bruce Amrein, Harford County, Md.; Curtis L. McCoy, Harford, Md.; James A. Martin, Lancaster, Pa.

[73] Assignee: The United States of America as represented by the Secretary of the Army, Washington, D.C.

[21] Appl. No.: 268,812

[22] Filed: Nov. 7, 1988

[51] Int. Cl.[4] ..... F02M 39/00

[52] U.S. Cl. ..... 123/198 D; 123/359; 251/215

[58] Field of Search ..... 123/497, 198 D, 357, 123/359; 251/215

[56] References Cited

U.S. PATENT DOCUMENTS

| | | | |
|---|---|---|---|
| 834,133 | 5/1907 | Whitaker | 251/215 |
| 1,487,646 | 3/1924 | Eustis | 251/215 |
| 1,493,281 | 5/1924 | Replogle | 251/215 |
| 2,833,512 | 5/1958 | Sanborn | 251/215 |
| 2,876,753 | 3/1959 | Chandler | 123/198 D |
| 4,129,040 | 12/1978 | Hayden | 123/198 D |
| 4,205,648 | 6/1980 | Graham | 123/497 |
| 4,291,532 | 9/1981 | Robinson | 123/198 D |
| 4,334,406 | 6/1982 | Todd | 123/198 D |

FOREIGN PATENT DOCUMENTS

| | | | |
|---|---|---|---|
| 0083527 | 7/1981 | Japan | 123/359 |

*Primary Examiner*—Carl Stuart Miller

*Attorney, Agent, or Firm*—Peter A. Taucher; David Kuhn

[57] ABSTRACT

Disclosed herein is a manually operated fuel bypass mechanism for an electronic fuel injection system, the mechanism adapted for convenient installation on the exterior of an existing fuel injection system.

12 Claims, 5 Drawing Sheets

MANUAL BYPASS FOR AN ELECTRONIC FUEL INJECTOR

BACKGROUND AND SUMMARY

This invention relates to control mechanisms for drive trains of vehicles and more particularly relates to manual bypass mechanisms for electronically controlled fuel injection systems in military vehicles such as M1 or M1A1 Tanks.

The U.S. Army now uses a fuel injection device known as an HMU or hydromechanical unit, on its M1 and M1A1 Tanks. The HMU is an assembly of electrically actuatable valves and other components which are controlled by an ECU (electronic control unit). To prevent engine damage, the ECU is programmed to initiate several protective modes and reduces fuel flow from the HMU if certain performance irregularities occur in the engine, transmission, or other propulsion system component. In one of the protective modes, referred to as "protective mode III", the flow rate of fuel to the engine is reduced to about 120 lbs./hour, so the engine generates only about 72 hp, or 5 percent of its capacity. The tank must move very slowly, at 1 mph, to a site where the propulsion system's problem can be analyzed.

In a battle or emergency scenario, it may be necessary to drive the tank faster than protective mode III permits. Further, it is possible that battle damage could cut off electrical power to the ECU and thereby adversely limit fuel flow to the engine.

To address these difficulties, we have created a completely mechanical fuel bypass device which routes additional fuel to the engine during protective mode III or during failure of the ECU. The device is a modular, add-on unit that can be installed on existing M1 or M1A1 tanks without disassembly of the hydromechanical units and which can be used without modifying the logic of the ECUs. The device has a screw-type metering valve which is highly accurate even though its metering shaft moves only a quarter turn between its zero-flow position to its fully open position. When our fuel bypass device is fully open, it permits a fuel flow of approximately 230 lbs/hr which when combined with fuel flow from the HMU, will produce about 400 hp, or nearly 30% of the engine's power. Consequently, the tank can travel out of danger 10 to 15 times faster than it ordinarily could during a protective mode III condition. Additionally, only a small movement of the mechanical linkage for the valve is needed to operate it, so the valve and linkage use relatively little of the limited space in the engine compartment.

DETAILED DESCRIPTION

Figure 1:
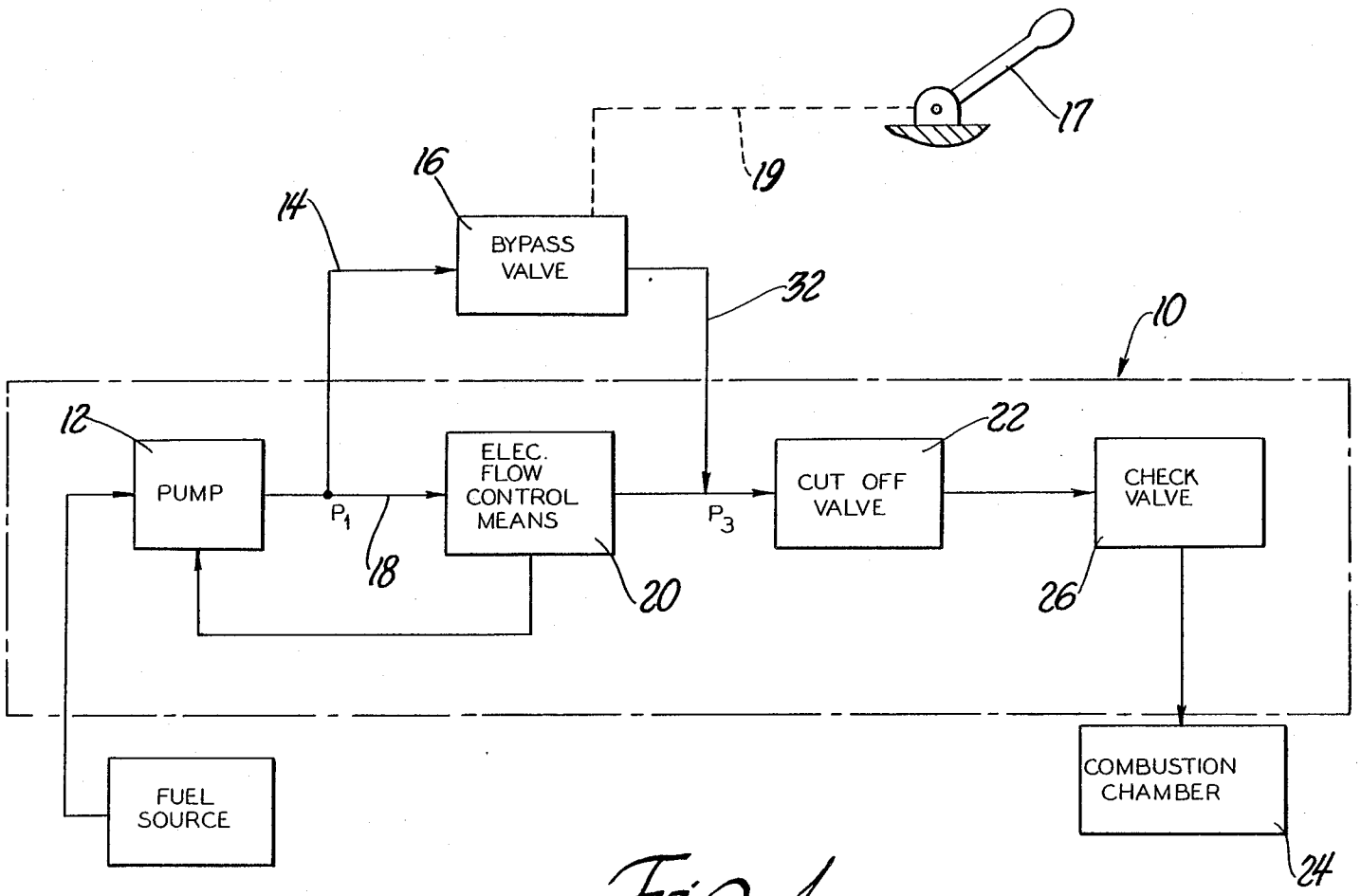
FIG. 1 is a simplified schematic diagram of a hydromechanical unit and a mechanically actuated bypass valve connected thereto.

In FIG. 1 is shown a hydromechanical unit 10 for supplying fuel to a tank engine, the unit including a constant-pressure fuel pump 12 typically operating at 500 to 1000 psi. Fuel from pump 12 passes through port P1 which is open both to line 14 leading to bypass valve 16 and line 18 which leads to an electronic flow control means 20. Bypass valve 16 is hydraulically in parallel with flow control means 20 and has a downstream port P3 in common with flow control means 20. The electronic flow control means passes only a regulated proportion of the fuel from the pump and returns the remaining fuel to the intake side of pump 12. Bypass valve 16 is controlled from a remote location by a control lever 17, the mechanical linkage between lever 17 and valve 16 being represented by dashed line 19 in FIG. 1. Immediately downstream of flow control means 20 and bypass valve 16 is a cut off valve 22, which shuts off fuel flow to combustion chamber 24 of the engine when the engine stops. Both flow control means 20 and cut off valve 22 are controlled by an electronic control unit, or ECU (not shown). Between the cut off valve 22 and the combustion chamber is a check valve 26 to prevent fuel from entering the combustion chamber once the engine has stopped.

When the ECU receives signals indicative of conditions potentially dangerous to the engine, the ECU typically initiates a protective mode wherein it permits only a minimum or threshold level of fuel to pass through flow control means 20, thereby safeguarding the engine from damage. Likewise, if the ECU is disabled or electrical power to the flow control means is interrupted, the flow control means reverts to a default mode wherein this same minimum or threshold amount of fuel is delivered to the engine. If it is desired to increase the amount of fuel to the engine under these conditions, then bypass valve 16 may be opened to the desired degree. Bypass valve 16 is independent of the ECU and is manually actuated by a mechanical linkage so valve 16 is unaffected by the ECU's protective mode or power failure to the ECU.

Figure 5:
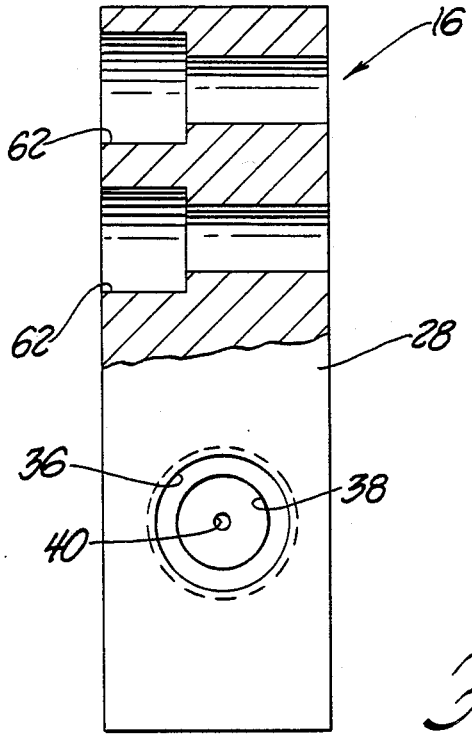
FIG. 5 is another partially cut away elevational view of the bypass valve.
Figure 4:
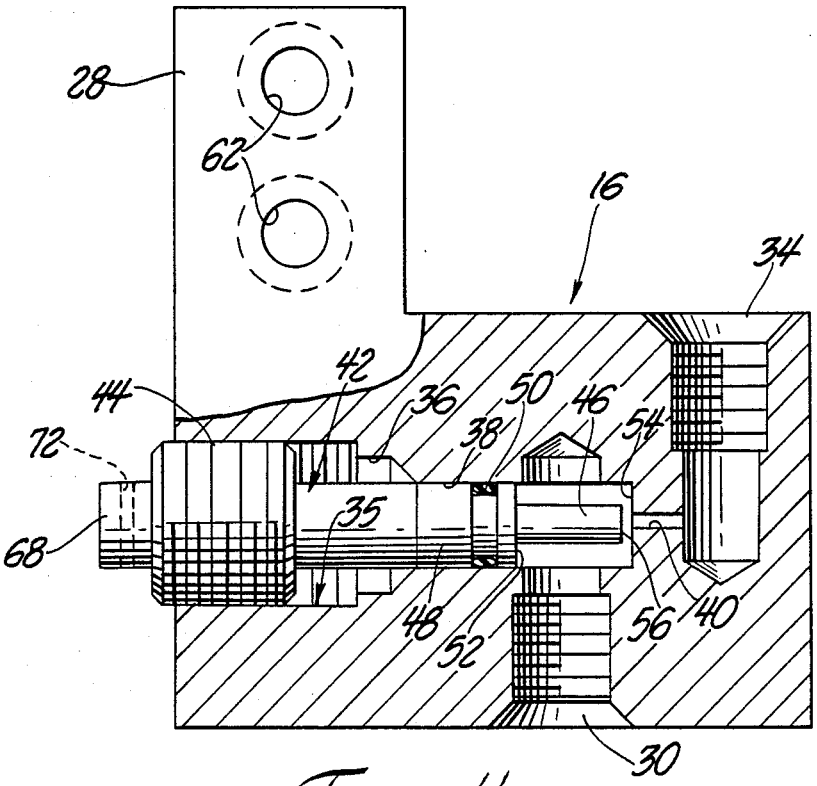
FIG. 4 is an elevational view of the bypass valve alone, part of the valve being cut away to show internal structure of the valve.

Bypass valve 16 is shown in greater detail in FIGS. 4 and 5, FIG. 4 showing the bypass valve in a partly open position. Valve 16 has a block-like housing 28 which defines a fuel entry chamber 30 communicating with line 14 and a fuel exit chamber 34 communicating with line 32 leading to port p3 of the HMU (FIG. 1). Housing 28 defines a stepped bore 35 having a diametrically larger cylinder 36 and a diametrically smaller cylinder 38. Stepped bore 35 accommodates a metering shaft 42 translatable toward or away from passage 40 to control the flow between entry chamber 30 and exit chamber 34. Passage 40 is restricted to limit the maximum flow through valve 16 so that overtravel of the metering shaft away from passage 40 does not increase fuel flow above a certain amount. By means of restricted passage 40, the tank crew member manually operating valve 16 will be prevented from accidentally destroying the engine by giving it too much fuel during a protective mode condition. In a typical application for the turbine engine of an M1 tank, the maximum fuel flow is between 300 and 350 lbs/hr.

The diametrically largest portion of metering shaft 42 is its threaded end 44 which engages a complimentarily threaded portion of the larger cylinder 36 at the mouth of stepped bore 35. The threads of threaded end 42 and larger cylinder 36 are typically spaced at 20 threads per inch. Between the ends of shaft 42 is shank 48 closely fit within and slideable in smaller cylinder 38 of stepped bore 35. Shank 48 defines an annular groove to accommodate an O-ring seal 50 for preventing the escape of fuel along metering shaft 42.

Adjacent shank 48 and forming shoulder 52 therewith is pin-like end 46 disposed in the intersection between chamber 30 and stepped bore 35. Pin-like end 46 has a flat circular face 56 opposingly parallel to flat end 54 of bore 35, face 56 being concentric with and diametrically larger than restricted passage 40, which opens at flat end 54.

Preferably, pin-like end 46 is sufficiently long to keep shoulder 52 out of the bore/chamber intersection when shaft 42 translates, thereby minimizing the extent to which metering shaft 42 affects flow in the intersection. Also, the diameter of pin-like end 46 is small enough to assure nonrestriction of flow in the intersection, this diameter typically being about one-half the diameter of the entry chamber 30. When shaft 42 is translated all the way to the right in FIG. 4, face 56 covers the opposed opening in restricted passage 40 to seal off flow between entry chamber 30 and exit chamber 34.

Figure 2:
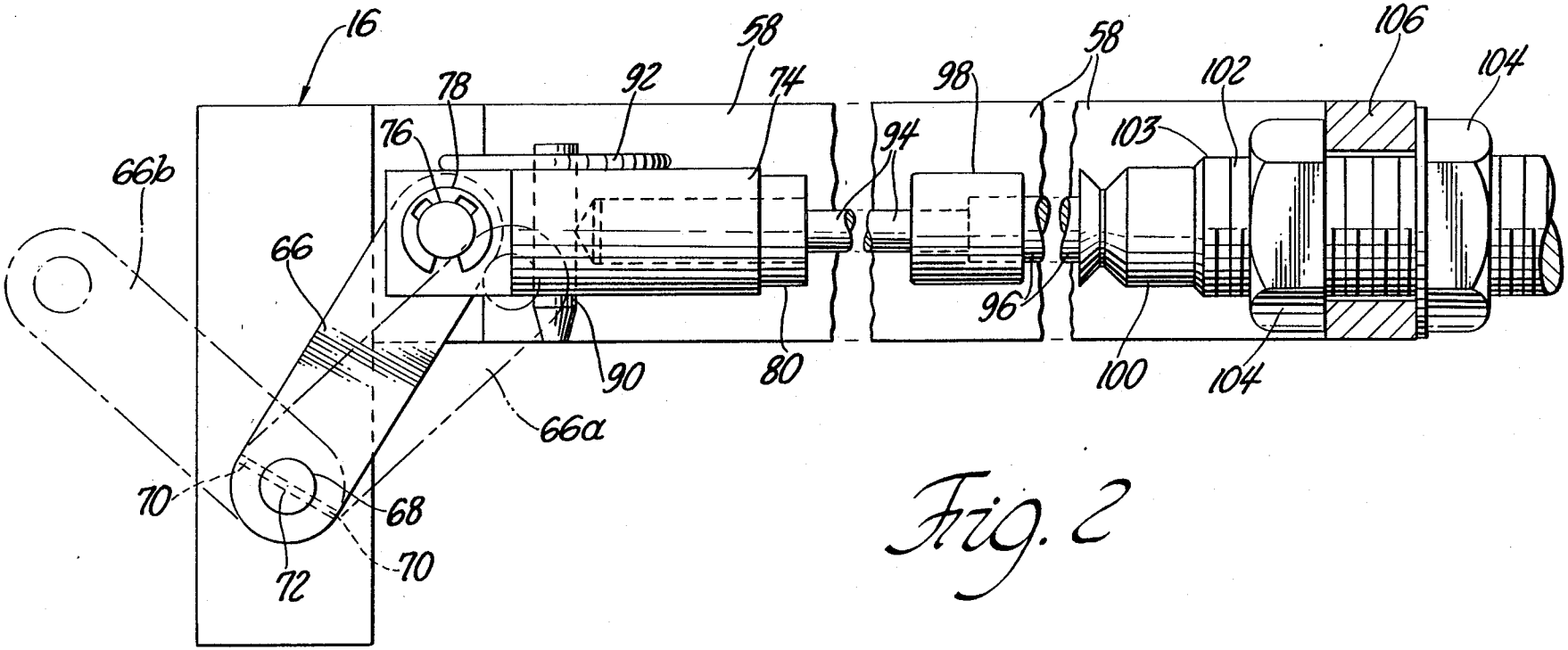
FIG. 2 is a side elevational view of the bypass valve and the associated mechanical linkage.
Figure 3:
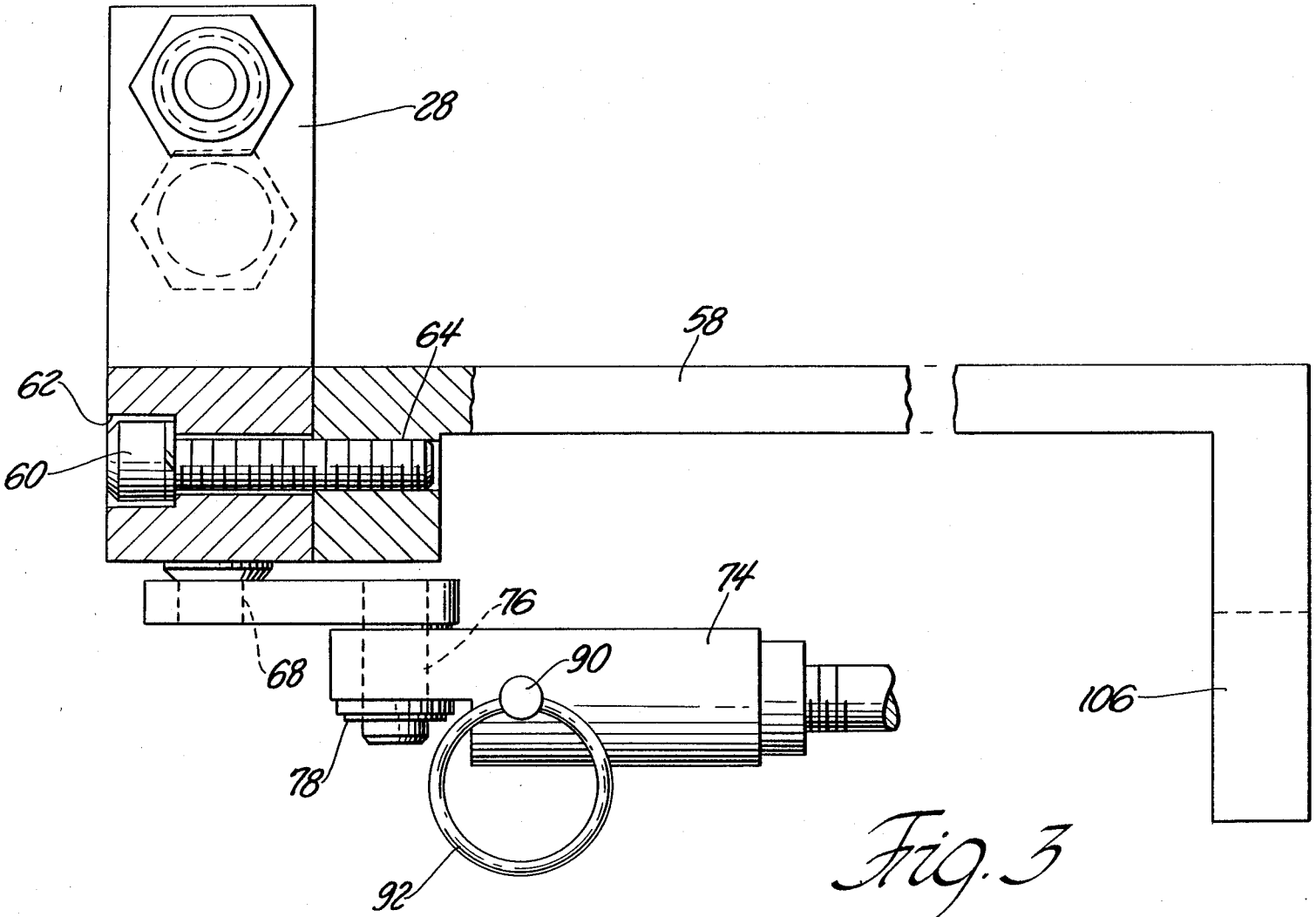
FIG. 3 is a partial plan elevational view of the bypass valve and associated linkage shown in FIG. 2.

Referring now to FIGS. 2 and 3, valve 28 is fastened to frame 58 by means of bolts 60 in countersunk bores 62 and bolt hole 64 in frame 58. Frame 58 is detachably mounted to the engine compartment of the tank (not shown) by any suitable means, such as bolts.

Frame 58 supports part of the mechanical linkage 19 (FIG. 1) by which valve 16 is operably connected to a manually actuated speed control lever 17 in the driver's compartment of the tank. As shown in FIG. 2, one end of the mechanical linkage is comprised of a valve lever 66 fixed to stub 68 of metering shaft 42. Lever 66 is typically installed by rotating metering shaft 42 its closed position, forming aperture 72 in stub 68 such that its axis will be 45 degrees counterclockwise from the vertical in FIG. 2, then slipping lever 66 onto stub 68 at a position 45 degrees clockwise from the vertical as shown at 66*a*, and then press fitting a roll pin through axially aligned apertures 70 and 72 in lever 66 and stub 68.

Figure 6:
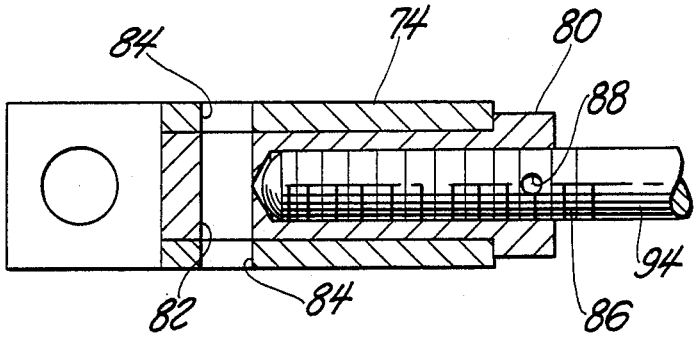
FIG. 6 shows structural details of the mechanical linkage which operates the bypass valve.

At the opposite end of lever 66 from stub 68 is a cable fastener 74, which is pivotally mounted on shaft 76 fixed to lever 66. A retaining ring 78 keeps cable fastener 74 on pin 76. As best shown in FIG. 6, cable fastener 74 receives a plug 80 defining a through passage 82 which aligns with holes 84 in cable fastener 74. A quick-release pin 90 (FIG. 3) holds plug 80 in cable fastener 74 and is provided with a ring handle 92 for easy removal of pin 90 from cable fastener 74. Plug 80 slidingly receives a cable end 86 retained in plug 80 by means of a press fit pin 88 passing through plug 80 and cable end 86.

As best seen in FIG. 2, a somewhat flexible cable 94 extends from plug 80 into cable sheath 96 having an elastomeric collar 98 to prevent dust and water from entering the sheath. Cable 94 extends to control lever 17 in the driver's compartment of the tank and is axially translatable in sheath 96 by this control lever. Surrounding a portion of sheath 96 and fixed thereto is a rigid cylindrical member 103 externally threaded as at 102 to engage nuts 104. An elastomeric sleeve 100 fits over the juncture between sheath 96 and cylindrical member 103 to prevent entry of contaminants therebetween. When nuts 104 are loosened, cylindrical member 103 can be removed from U-shaped bracket 106, which has its legs pointed toward the viewer in FIG. 2. By alternately loosening and tightening nuts 104, one can adjust the axial position of the cable assembly (comprised of the cylindrical member 103, sheath 96, cable 94, and cable fastener 74) relative to frame 58.

When the tank crew member moves control lever 17, the cable assembly pivots lever 66 to a selected location between the fully closed position 66*a* and the fully open position 66*b*, which is 90 degrees away. The operational range of lever 66 (between positions 66*a* and 66*b*) is selected so that the cable assembly undergoes a minimum of vertical bending when moving lever 66. As lever 66 is moved appreciably counterclockwise beyond position 66*b*, the bending of the cable assembly increases dramatically, making it necessary for the crew member to exert a discernably greater force to continue moving control lever 17. The crew member thus knows when lever 66 has exceeded its fully open position without visually monitoring control lever 17.

When the crew member moves control lever 17 to close valve 16, flat face 56 (FIG. 4) of metering shaft 42 eventually stops against flat end 54 of stepped bore 35. Thus, valve 16 incorporates a very simple mechanical stop to signal closure of lever 17, obviating the need for a mechanical stop in linkage 19 between valve 16 and lever 17.

We wish it to be understood that we do not desire to be limited to the exact details of construction shown and described since modifications may occur to those skilled in the art without departing from the spirit and scope of the following claims.

We claim:

1. A bypass mechanism for an electronically governed fuel flow control means, comprising:

a valve assembly including a housing defining a fuel entry chamber, a fuel exit chamber, a bore intersecting the fuel entry chamber, and a flow restriction orifice connecting the bore to the fuel exit chamber;

the bore defining a radially smaller cylinder and a radially larger cylinder, the larger cylinder being at least partly threaded;

a rotatable metering shaft in the bore having a threaded end matingly engaged with the larger cylinder, the shaft defining a pin-like end in the fuel entry chamber having an end face opposed to and larger than the orifice, the shaft having a shank fitting closely through the smaller cylinder, the pin-like end being no shorter than the width of the fuel entry chamber, so the shank never enters the fuel entry chamber to affect flow therein, the juxtaposition of the end face and the orifice being substantially the sole means to vary flow into the orifice;

an elongate frame demountably attached to the engine compartment of a tank and having the housing mounted to one end thereof;

a lever attached to the metering shaft in the housing;

a push-pull cable connected to actuate the lever, the cable detachably and slideably retained at the other end of the frame, the cable extending into connection with a remote manual control means for rotating the metering shaft.

2. The mechanism of claim 1 wherein the threads of the metering shaft are pitched such that a quarter turn of the metering shaft moves the end face on the pin-like end of the shaft from a first position where it seals the restriction orifice to a second position where the fuel flow between the end face and the flat end of the bore is equal to the maximum fuel flow through the restriction orifice.

3. The mechanism of claim 2 wherein the threads are spaced at 20 threads per inch.

4. The mechanism of claim 1 including a lever attached to the metering shaft in the housing, wherein the lever travels approximately 90 degrees when moving the metering shaft from its fully open position to its fully closed position, the lever staying within approximately a 45 degree angle of a line normal to the axis of the cable while moving the shaft.

5. The mechanism of claim 1 wherein the cable passes through a U-shaped bracket at the other end of the frame, there being means at the U-shaped bracket for adjusting the axial position of the cable relative to the frame.

6. The mechanism of claim 1 wherein the push-pull cable includes an inflexible cylindrical member by which the push-pull cable is mounted to the frame, a relatively flexible cable portion extending from the cylindrical member toward the lever, the relatively flexible cable being less than four times the length of the lever.

7. An add-on bypass mechanism retrofittable onto an electronic fuel injection system of a tank wherein the fuel injection system includes a constant-pressure fuel pump, an electronically governed fuel flow control means hydraulically downstream of the pump, and a combustion chamber for the tank engine hydraulically downstream of the flow control means, the bypass mechanism comprising:

a valve assembly exterior to the fuel injection system connected hydraulically between the pump and the combustion chamber so as to be hydraulically in parallel with the electronically governed flow control means, the valve assembly including a housing defining a fuel entry chamber communicated with the fuel pump, a fuel exit chamber communicated with the combustion chamber, a stepped, flat ended bore perpendicularly intersecting the fuel entry chamber, and a flow restriction orifice leading from the flat end of the flat ended bore to the fuel exit chamber;

the flat ended bore defining a radially smaller cylinder adjacent its flat end and a radially larger cylinder adjacent its shaft entry end, the larger cylinder being at least partly threaded;

a metering shaft concentrically disposed in the bore having a threaded shaft end threaded with the larger cylinder of the bore, the metering shaft having a pin-like end disposed in the intersection between the fuel entry chamber and the bore, the pin-like end having a planar face opposingly parallel to the restriction orifice, and being diametrically larger than the restriction orifice, the metering shaft having a shank intermediate the ends of the shaft, the shank radially larger than the pin-like end and radially smaller than the threaded shaft end, the shank passing through the smaller cylinder of the bore and fitting closely therein.

8. The mechanism of claim 7 including a manually actuatable linkage means for rotating the metering shaft, the linkage means including a feedback means to send a palpable signal when the metering shaft exceeds a given range of movement.

9. A vehicle fuel supply system having a fuel pump; an electronically controlled accelerator valve hydraulically downstream of the pump for selecting the speed of the vehicle, the electronically controlled accelerator valve having a means for varying the cross-sectional area of a main stream of fuel therethrough; a combustion chamber defined by an engine in the vehicle and located downstream of the electronically controlled metering valve; a bypass mechanism for routing fuel around the electronically controlled accelerator valve, the bypass mechanism including a redundant accelerator valve hydraulically in parallel with the electronically controlled accelerator valve, the redundant valve acting to determine the rate of speed of the vehicle and having a means for altering the cross-sectional area of a bypass stream of fuel therethrough, the altering means of the redundant valve operable independently of the varying means of the electronically controlled acceleration valve; and a manually operable linkage to control the altering means, the linkage being connected between the altering means a driver compartment for the vehicle.

10. The vehicle supply system of claim 9 wherein the the bypass mechanism is a modular unit detachably fixed to the vehicle.

11. The vehicle supply system of claim 10 wherein the linkage is comprised of a frame mounted to the vehicle and a cable connected between the driver's compartment and the redundant valve.

12. The vehicle fuel supply system of claim 9 wherein the minimum rate of fuel flow through the electronically controlled metering valve is greater than zero.

* * * * *